US007163065B2

(12) United States Patent
Zhang et al.

(10) Patent No.: US 7,163,065 B2
(45) Date of Patent: Jan. 16, 2007

(54) COMBINED TELEMETRY SYSTEM AND METHOD

(75) Inventors: Zhiyi Zhang, Houston, TX (US); Bruno Best, Zoetermeer (NL); Gilberto Toffolo, Agnadello (IT)

(73) Assignee: Shell Oil Company, Houston, TX (US)

( * ) Notice: Subject to any disclaimer, the term of this patent is extended or adjusted under 35 U.S.C. 154(b) by 171 days.

(21) Appl. No.: 10/730,235

(22) Filed: Dec. 8, 2003

(65) Prior Publication Data

US 2004/0163822 A1 Aug. 26, 2004

Related U.S. Application Data

(60) Provisional application No. 60/431,360, filed on Dec. 6, 2002.

(51) Int. Cl.
*G01V 1/00* (2006.01)

(52) U.S. Cl. ..... 166/385; 340/854.4; 340/854.5

(58) Field of Classification Search .. 340/854.3–854.9; 166/385
See application file for complete search history.

(56) References Cited

U.S. PATENT DOCUMENTS

| | | | | |
|---|---|---|---|---|
| 2,379,800 | A | 7/1945 | Hare | 175/356 |
| 2,414,719 | A | 1/1947 | Cloud | 178/44 |
| 3,090,031 | A | 5/1963 | Lord | 340/18 |
| 3,904,840 | A | 9/1975 | Kostelnicek | 191/12 |
| 4,220,381 | A | 9/1980 | Van der Graaf | 339/16 C |
| 4,496,174 | A | 1/1985 | McDonald et al. | 285/53 |
| 4,547,774 | A | 10/1985 | Gould | 340/854 |
| 4,585,287 | A | 4/1986 | Ramsey et al. | 339/60 |
| 4,598,290 | A | 7/1986 | Collins et al. | 340/850 |
| 4,605,268 | A | 8/1986 | Meador | 339/16 |
| 4,691,203 | A | 9/1987 | Rubin et al. | 340/856 |
| 4,725,837 | A | 2/1988 | Rubin | 340/855 |
| 4,739,325 | A | 4/1988 | MacLeod | 340/854 |
| 4,788,544 | A | 11/1988 | Howard | 340/853 |
| 4,806,928 | A | 2/1989 | Veneruso | 340/856 |
| 4,828,051 | A | 5/1989 | Titchener et al. | 175/50 |
| 4,901,069 | A | 2/1990 | Veneruso | 340/853 |
| 4,945,761 | A | 8/1990 | Lessi et al. | 73/151 |
| 5,083,875 | A | 1/1992 | Cedrone | 385/139 |
| 5,128,901 | A | 7/1992 | Drumheller | 367/82 |
| 5,142,990 | A | 9/1992 | Leonard | 104/138.2 |
| 5,160,925 | A | 11/1992 | Dailey et al. | 340/853.3 |
| 5,163,521 | A | 11/1992 | Pustanyk et al. | 175/40 |
| 5,294,923 | A | 3/1994 | Juergens et al. | 340/854.9 |
| 5,359,324 | A | 10/1994 | Clark et al. | 340/854.3 |
| 5,410,303 | A | 4/1995 | Comeau et al. | 340/853.3 |
| 5,602,541 | A | 2/1997 | Comeau et al. | 340/853.3 |
| 5,703,836 | A | 12/1997 | Drumheller | 367/165 |
| 5,833,015 | A | 11/1998 | Hesse et al. | 175/40 |
| 5,945,923 | A | 8/1999 | Soulier | 340/854.6 |
| 6,041,872 | A | 3/2000 | Holcomb | 175/40 |
| 6,147,932 | A | 11/2000 | Drumheller | 367/165 |
| 6,188,647 | B1 | 2/2001 | Drumheller | 367/165 |
| 6,308,787 | B1 | 10/2001 | Alft | 175/48 |

(Continued)

FOREIGN PATENT DOCUMENTS

| | | |
|---|---|---|
| EP | 399987 | 11/1990 |

(Continued)

*Primary Examiner*—William Neuder

(57) ABSTRACT

Telemetry systems and methods are disclosed for real time communication of information between multiple positions in a wellbore.

41 Claims, 8 Drawing Sheets

U.S. PATENT DOCUMENTS

| | | | | |
|---|---|---|---|---|
| 6,378,627 | B1 | 4/2002 | Tubel et al. | 175/24 |
| 6,655,453 | B1 | 12/2003 | Head | 166/77.1 |
| 6,909,667 | B1 * | 6/2005 | Shah et al. | 367/83 |
| 2002/0014340 | A1 | 2/2002 | Johnson | 166/380 |
| 2002/0075114 | A1 | 6/2002 | Hall et al. | 336/192 |
| 2002/0140572 | A1 * | 10/2002 | Gardner et al. | 340/853.3 |
| 2003/0151977 | A1 * | 8/2003 | Shah et al. | 367/82 |
| 2004/0074639 | A1 | 4/2004 | Runia | 166/254.2 |
| 2004/0145492 | A1 | 7/2004 | Hall et al. | 340/854.3 |
| 2005/0270172 | A1 * | 12/2005 | Bailey et al. | 340/854.3 |

FOREIGN PATENT DOCUMENTS

| | | | |
|---|---|---|---|
| EP | 0 553 732 | A1 | 1/1993 |
| EP | 426820 | B1 | 1/1996 |
| EP | 0 540 425 | B1 | 9/1996 |
| WO | 92/18882 | | 10/1992 |
| WO | WO 92/18882 | | 10/1992 |
| WO | WO 00/73625 | | 12/2000 |
| WO | 03/089760 | A1 | 10/2003 |

* cited by examiner

COMBINED TELEMETRY SYSTEM AND METHOD

CROSS-REFERENCE TO RELATED APPLICATIONS

This application claims priority of provisional application 60/431,360, which was filed with the United States Patent and Trademark Office on Dec. 6, 2002.

FIELD OF INVENTION

The present invention relates to real time data telemetry systems and methods for communicating information between multiple positions in a wellbore. More particularly, the present invention relates to telemetry systems and methods that may be used during drilling operations for communicating information, unidirectionally or bidirectionally, between sensors located near a drilling bit and receiving devices at the surface. The present invention may be particularly useful for drilling operations requiring ultra-high data-rate transmission.

BACKGROUND OF THE INVENTION

Directional drilling involves controlling the direction of a borehole as it is being drilled. Since boreholes are drilled in three-dimensional space, the direction of a borehole includes both its inclination relative to vertical (dip) as well as its azimuth. Usually the goal of directional drilling is to reach a target subterranean destination with the drill string, typically a potential hydrocarbon producing formation.

In order to optimize the drilling operation, it is often desirable to be provided with information concerning the environmental conditions of the surrounding formation being drilled and information concerning the operational and directional parameters of the downhole motor drilling assembly including the drilling bit. For instance, it is often necessary to adjust the direction of the borehole while directional drilling, either to accommodate a planned change in direction or to compensate for unintended and unwanted deflection of the borehole. In addition, it is desirable that information concerning the environmental, directional and operational parameters of the drilling operation be provided to the operator on a real time basis. The ability to obtain real time data measurements while drilling permits a relatively more economical and more efficient drilling operation.

For example, the performance of the downhole motor drilling assembly, and in particular the downhole motor, and the life of the downhole motor may be optimized by the real time transmission of the temperature of the downhole motor bearings or the rotations per minute of the drive shaft of the motor. Similarly, the drilling operation itself may be optimized by the real time transmission of environmental or borehole conditions such as the measurement of natural gamma rays, borehole inclination, and borehole pressure, resistivity of the formation and weight on bit. Real time transmission of this information permits real time adjustments in the operating parameters of the downhole motor drilling assembly and real time adjustments to the drilling operation itself.

Accordingly, various measurement-while-drilling (MWD) systems have been developed that permit downhole sensors to measure real time drilling parameters and to transmit the resulting information or data to the surface substantially instantaneously with the measurements. For instance, MWD mud pulse telemetry systems transmit signals from an associated downhole sensor to the surface through the drilling mud in the drill string. More particularly, pressure or acoustic pulses, modulated with the sensed information from the downhole sensor, are applied to the mud column and are received and demodulated at the surface. The downhole sensor may include various sensors such as gamma ray, resistivity, porosity or temperature sensors for measuring formation characteristics or other downhole parameters. In addition, the downhole sensor may include one or more magnetometers, accelerometers or other sensors for measuring the direction or inclination of the borehole, weight-on-bit or other drilling parameters.

Typically, MWD systems, such as the MWD mud pulse telemetry system, are located above the downhole motor drilling assembly. For instance, when used with a downhole motor, the MWD mud pulse telemetry system is typically located above the motor so that it is spaced a substantial distance from the drilling bit in order to protect or shield the electronic components of the MWD system from the effects of any vibration or centrifugal forces emanating from the drilling bit. Further, the downhole sensors associated with the MWD system are typically placed in a non-magnetic environment by utilizing Monel collars in the drill string below the MWD system.

Thus, the MWD system may be located a significant distance from the drilling bit. As a result, the environmental information measured by the MWD system may not necessary correlate with the actual conditions surrounding the drilling bit. Rather, the MWD system is responding to conditions that are substantially spaced from the drilling bit. For instance, a conventional MWD system may have a depth lag of up to or greater than 60 feet. As a result of this information delay, it is possible to drill completely through a potential hydrocarbon producing formation before detecting its presence, requiring costly corrective procedures.

In response to this undesirable information delay or depth lag, various near bit sensor systems or packages have been developed which are designed to be placed adjacent or near the drilling bit. The near bit system permits the detection of the potential hydrocarbon producing formation almost immediately upon its penetration, minimizing the need for unnecessary drilling and service costs. The drilling operation, including the trajectory of the drilling bit, may then be adjusted in response to the sensed information. However, in order to use a near bit sensor system and permit real time monitoring and adjustment of drilling parameters, a system or method must be provided for transmitting the measured data or sensed information from the downhole sensor either directly to the surface or to a further MWD system for subsequent transmission to the surface. Various attempts have been made in the prior art to transmit the information directly or indirectly to the surface. However, none of these attempts have provided a fully satisfactory solution.

Various systems have been developed for communicating or transmitting the information directly to the surface through an electrical line, wireline or cable to the surface. These hard-wire connectors provide a hard-wire connection from the drilling bit to the surface, which has a number of advantages. For instance, these connections typically permit data transmission at a relatively high rate and permit two-way or bidirectional communication. However, these systems also have several disadvantages.

First, a wireline or cable must be installed in or otherwise attached or connected to the drill string. This wireline or cable is subject to wear and tear during use of the system and thus, may be prone to damage or even destruction during normal drilling operations. For instance, the downhole motor drilling assembly may not be particularly suited to accommodate such wirelines running through the motor, with the result that the wireline sensors may need to be spaced a significant distance from drilling bit. Further, the wireline may be exposed to excessive stresses at the point of connection between the sections of drill pipe comprising the drill string. As a result, the system may be somewhat unreliable and prone to failure, which may result in costly inspection, servicing and replacement of the wireline. In addition, the presence of the wireline or cable may require a change in the usual drilling equipment and operational procedures. The downhole motor drilling assembly may need to be particularly designed to accommodate the wireline. As well, the wireline may need to be withdrawn and replaced each time a joint of pipe is added to the drill string. These disadvantages result in a relatively complex and unreliable system for transmitting the sensed information.

Systems have also been developed for the transmission of acoustic or seismic signals or waves through the drill string or surrounding formation. A downhole acoustic or seismic generator generates the acoustic or seismic signals. However, a relatively large amount of power is typically required downhole in order to generate a sufficient signal such that it is detectable at the surface. To generate a sufficient signal, the necessary power may be supplied to the generator by a hard wire connection from the surface to the downhole generator. Alternately, a relatively large power source must be provided downhole.

U.S. Pat. No. 5,163,521 issued Nov. 17, 1992 to Pustanyk, et al., U.S. Pat. No. 5,410,303 issued Apr. 25, 1995 to Comeau, et al., and U.S. Pat. No. 5,602,541 issued Feb. 11, 1997 to Comeau, et al. all describe a MWD tool, a downhole motor having a bearing assembly and a drilling bit. A sensor and a transmitter are provided in a sealed cavity within the housing of the downhole motor bearing assembly, adjacent the drilling bit. A signal from the sensor is transmitted by the transmitter to a receiver in the MWD tool. The MWD tool then transmits the information to the surface. The signals are transmitted from the transmitter to the receiver by a wireless system. Specifically, the information is transmitted by frequency modulated acoustic signals indicative of the sensed information. Preferably, the transmitted signals are acoustic signals having a frequency in the range of from 500 to 2,000 Hz. However, alternatively, radio frequency signals of up to 3,000 mega-Hz may be used.

Further systems have been developed which require the transmission of electromagnetic signals through the surrounding formation. Electromagnetic transmission of the sensed information often involves the use of a toroid positioned adjacent the drilling bit for generation of an electromagnetic wave through the formation. Specifically, a primary winding, carrying the sensed information, is wrapped around the toroid and the drill string forms a secondary winding. A receiver may be either connected to the ground at the surface for detecting the electromagnetic wave or may be associated with the drill string at a position uphole from the transmitter.

Generally speaking, as with acoustic and seismic signal transmission, the transmission of electromagnetic signals through the formation typically requires a relatively large amount of power, particularly where the electromagnetic signal must be detectable at the surface. Further, attenuation of the electromagnetic signals as they are transmitted through the formation is increased with an increase in the distance over which the signals must be transmitted, an increase in the data transmission rate and an increase in the electrical resistivity of the formation. The conductivity and the heterogeneity of the surrounding formation may particularly adversely affect the propagation of the electromagnetic radiation through the formation. As well, noise in the drill string, particularly from the downhole motor drilling assembly, may interfere with the detection of the electromagnetic signals.

Thus, as with acoustic and seismic signal transmission, in order to be able to generate a sufficient electromagnetic signal, the necessary power may need to be supplied to a downhole electromagnetic generator by a hard wire connection from the surface. Alternately, a relatively large power source may be provided downhole.

Finally, when utilizing a toroid for the transmission of the electromagnetic signal, the outer sheath of the drill string must protect the windings of the toroid while still providing structural integrity to the drill string. This is particularly important given the location of the toroid in the drill string since the toroid is often exposed to large mechanical stresses during the drilling operation. Further, in order to avoid short-circuiting of the system or a short circuit turn of the signals through the drill string and in order to enhance the propagation of the electromagnetic radiation through the surrounding formation, an electrical discontinuity is provided in the drill string. The electrical discontinuity typically comprises an insulative gap or insulated zone provided in the drill string. An insulating material comprising a substantial area of the outer sheath or surface of the drill string may provide the insulative gap. For instance, the insulating material may extend for ten to thirty feet along the drill string. Thus, the need for the insulative gap to be incorporated into the drill string may interfere with the structural integrity of the drill string resulting in a weakening of the drill string at the gap. Further, the insulating material provided for the insulative gap may be readily damaged during typical drilling operations.

Various attempts have been made in the prior art to address these difficulties or disadvantages associated with electromagnetic transmission systems. However, none of these attempts have provided a fully satisfactory solution.

U.S. Pat. No. 4,496,174 issued Jan. 29, 1985 to McDonald, et al. and U.S. Pat. No. 4,725,837 issued Feb. 16, 1988 to Rubin discloses an insulated drill collar gap sub-assembly for a toroidal-coupled telemetry system. The sub-assembly provides a dielectric material in the insulative gap, while attempting to enhance the structural integrity of the sub-assembly at the gap. Although the sub-assembly may enhance the structural integrity of the drill string, the system still requires the propagation of the electromagnetic radiation through the formation to the surface. Specifically, electromagnetic waves are launched from a transmitting toroid in the form of electromagnetic waves traveling through the earth. These waves eventually penetrate the earth's surface and are picked up by an uphole receiving system. The uphole receiving system comprises a plurality of radially extending arms of electrical conductors about the drilling platform, which are laid on the ground surface and extend for three to four hundred feet away from the drill site. These receiving arms intercept the electromagnetic waves and send the corresponding signals to a receiver.

U.S. Pat. No. 4,691,203 issued Sep. 1, 1987 to Rubin, et al. is directed at a downhole telemetry apparatus for transmitting electromagnetic signals to the surface. The apparatus includes a mode transducer designed to avoid the need for a toroidal transformer. The transducer provides a total electrical discontinuity in the drill string so that a potential difference can be produced across adjacent conducting faces of the drill string. Essentially, the adjacent conducting faces of the drill string are separated from each other by a predetermined insulative gap. Insulation around the gap is selected to induce optimum earth currents when the electrical signal is applied across the faces. Once the signal crosses the insulative gap, it is conducted to the surface through an upper portion of the drill string, where it is transferred from the drill string through a wire to an input transformer for a surface receiver. Once flowing through the transformed primary, the signal is transmitted through a wire installed in the ground near the surface. The electrical signal from the wire propagates through the earth back to the downhole sensor unit and finally completes its path into the mode transducer.

U.S. Pat. No. 5,160,925 issued Nov. 3, 1992 to Dailey, et al. and PCT International Application PCT/US92/03183 published Oct. 29, 1992 as WO 92/18882 are directed at a short hop communication link for a downhole MWD system. The system comprises a sensor module, a control module, a host module and a mud pulsar. The sensor module includes a transmitter for transmitting an electromagnetic signal, indicative of the information measured by the sensor, to the control module and a receiver for receiving commands from the control module. The control module includes a transceiver for transmitting command signals and receiving signals from the sensor module. Further, the control module transmits electrical signals to the host module through a hard wire connection, which similarly connects to the mud pulsar.

Both the sensor and control modules include an antenna arrangement through which the electromagnetic signals are sent and received through a short hop communication link. The sensor and control antennas are transformer coupled, insulated gap antennas. More particularly, communication between the sensor and control modules is effected by electromagnetic propagation through the surrounding conductive earth. The signal is impressed across an insulated axial gap in the outer diameter of the drill string, represented by the antennas, either by transformer coupling or by direct drive across a fully insulated gap in the assembly. The electromagnetic wave from the antenna propagates through the surrounding conductive earth, accompanied by a current in the metal drill string. As the formation conductance increases and resistance decreases, the maximum frequency with acceptable attenuation will decrease. Preferably, a frequency in the range of about 100 to 10,000 Hz is used.

U.S. Pat. No. 5,359,324 issued Oct. 25, 1994 to Clark, et al. and European Patent Specification EP 0 540 425 B1 published Sep. 25, 1996 are directed at an apparatus for determining earth formation resistivity and sending the information to the surface. The apparatus utilizes a first toroidal coil antenna mounted, in an insulating medium, on a drill collar for transmitting and/or receiving modulated information signals which travel through the surrounding earth formation. A second toroidal coil antenna is also mounted, in an insulating medium, on the drill collar for transmitting and/or receiving the modulated information signals to and from the first antenna.

More recent approaches have involved the use of special drill pipe equipped with data links. The disadvantages of this method include high cost associated with the special pipes and unreliability of the couplings in the joints.

Optic fiber has been used to provide a broadband telemetry system. U.S. Pat. No. 6,041,872 teaches an apparatus having a bared optic fiber cable stored in a spool. The spool can be fit into the drill string and thus the cable will not interfere with adding additional pipes. That attempt has failed because the naked optic fiber cannot withstand the harsh drilling environment. U.S. Pat. No. 6,655,453 records another attempt using armored fiber optic cable for telemetry purposes. Because of the limited space for the cable spool inside the drill string, cable diameter must be small in order to cover the entire borehole length. A thin cable, however, usually means a weak cable that may break in the harsh drilling environment.

As revealed above, there remains a need in the industry for reliable real time data telemetry systems and methods for communicating information between multiple positions in a wellbore. The proposed systems and methods of the present invention therefore, address the disadvantages or difficulties associated with conventional telemetry systems and methods.

SUMMARY OF THE INVENTION

The present invention relates to real time data telemetry systems and methods for communicating a signal between multiple positions in a wellbore.

In one embodiment, the present invention comprises a combined telemetry system for communicating a signal between multiple positions in a wellbore, wherein the system comprises a lower sub-telemetry system coupled at one end to a sensor, and an upper sub-telemetry system coupled at one end to another end of the lower sub-telemetry system and coupled at another end to at least one of a signal receiver and a signal transmitter.

In another embodiment, the present invention comprises a combined telemetry system for communicating a signal between multiple positions in a weilbore, wherein the system comprises a lower sub-telemetry system, an upper sub-telemetry system, and a middle sub-telemetry system for coupling the lower sub-telemetry system to the upper sub-telemetry system.

In yet another embodiment, the present invention comprises a coupling system for electrically connecting multiple components in a wellbore, wherein the system comprises a first ring coupled with a first transmission wire, and a second ring coupled with a second transmission wire.

In yet another embodiment, the present invention comprises a coupling system for electrically connecting multiple sections of drill pipe in a wellbore, wherein the system comprises: i) a first drill pipe section having a longitudinal passage therethrough and a first transmission wire attached to an inside surface of the longitudinal passage, the first drill pipe section including a pin end; ii) a conical pin end cap, the end cap comprising a cap ring positioned at one end of the end cap, a cap plate positioned at another end of the end cap, and a cap wire electrically connecting the cap ring and the cap plate, the first transmission wire contacting the cap plate when the end cap and the first drill pipe section are coupled; iii) a second drill pipe section having a longitudinal passage therethrough and a second transmission wire attached to an inside surface of the longitudinal passage, the second drill pipe section including a box end; iv) a conical box end insert, the end insert comprising an insert ring positioned at one end of the end insert, an insert plate positioned at another end of the end insert, and an insert plate, the insert plate contacting the second transmission wire when the end insert and the second drill pipe section are coupled; and v) the cap ring being positioned sufficiently close in proximity to the insert ring to transmit a signal through inductive coupling when the end cap and the end insert are coupled.

In yet another embodiment, the present invention comprises a method for manipulating a lower cable sub-telemetry system through drill pipe in a wellbore, wherein the method comprises the steps of: i) connecting one end of the cable to a wet connector and another end of the cable to a hanging sub, the hanging sub providing for the deployment of a predetermined length of cable; ii) pumping a fluid through the drill pipe behind the wet connector to force the wet connector and the cable to deploy through the drill pipe as the fluid is pumped through the drill pipe; and iii) securing the wet connector at a predetermined position within the drill pipe.

BRIEF DESCRIPTION OF THE SEVERAL VIEWS OF THE DRAWING

Embodiments of the invention will now be described with reference to the accompanying drawings, in which like reference numbers indicate identical or functionally similar elements.

DETAILED DESCRIPTION OF THE INVENTION

The present invention relates to systems and methods for communicating information axially along a drill string within a wellbore by conducting an axial signal embodying the information (data) between a first axial position in the wellbore and a second axial position in the wellbore. The telemetry signals may comprise the same or different signal types including, but not limited to, acoustic, electric, optic and/or electromagnetic ("EM") signals.

Each system may be used to communicate information along any length of drill string from the first axial position to the second axial position or from the second axial position to the first axial position. Preferably, each system is capable of communicating information in both directions along the drill string so that the information can be communicated either toward the surface or away from the surface of a wellbore in which the drill string is contained.

Information communicated toward the surface may relate to drilling operations or the drilling environment including, for example, weight-on-bit, natural gamma ray emissions, borehole inclination, borehole pressure, and mud cake resistivity. Information communicated toward the wellbore may relate to instructions sent from the surface including, for example, signals from the surface prompting for information or instructions from the surface to alter drilling operations where a downhole motor drilling assembly is being used.

The systems and methods of the present invention may be used in any field operation where bi-directional data communication in the wellbore is needed, and is particularly productive as a component of a measurement-while-drilling (MWD), logging-while-drilling (LWD), or geosteering system providing communication to and from the surface during drilling operations. Geosteering is the intentional directional control of a wellbore based on the results of downhole geological measurements, rather than focusing on three-dimensional targets in space. Geosteering may therefore, be used to direct the wellbore for purposes of minimizing gas or water breakthrough and maximizing wellbore production. Geosteering may require ultra high data rate telemetry (UDRT) in order to transmit real-time data when the bit is close to the production zone or target zone. A geosteering application using UDRT typically implies a transmission rate above 1,000 bps.

Figure 2:
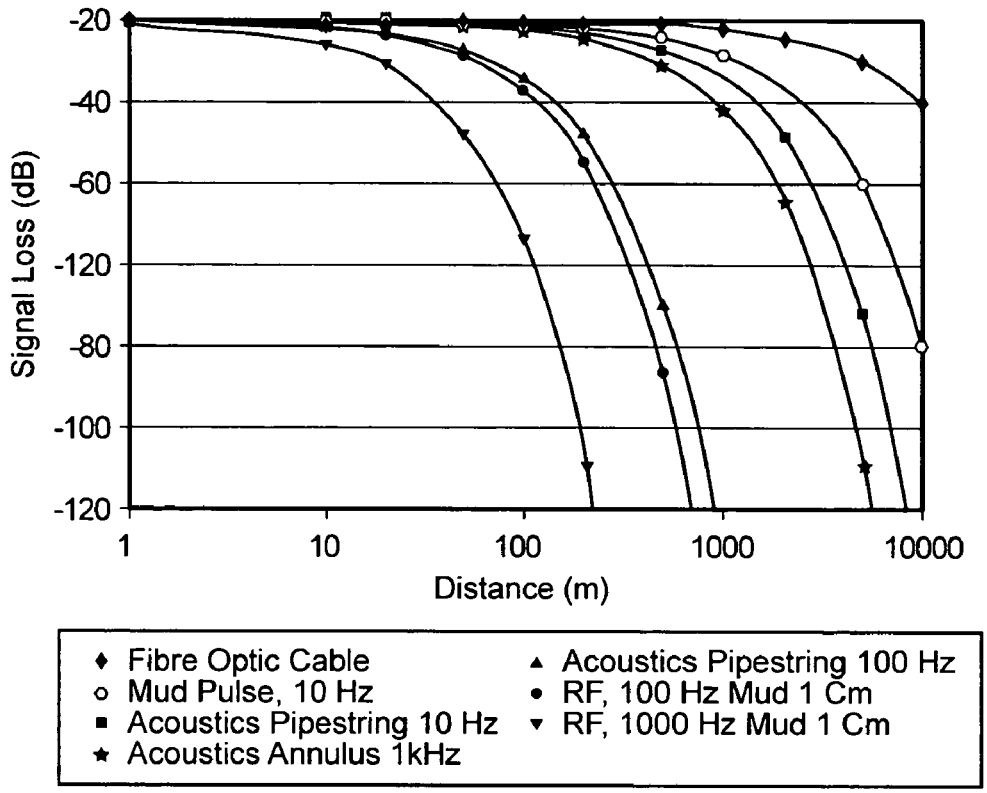
FIG. 2 is a graph comparing the attenuation of different signals to transmission distance.
Figure 3:
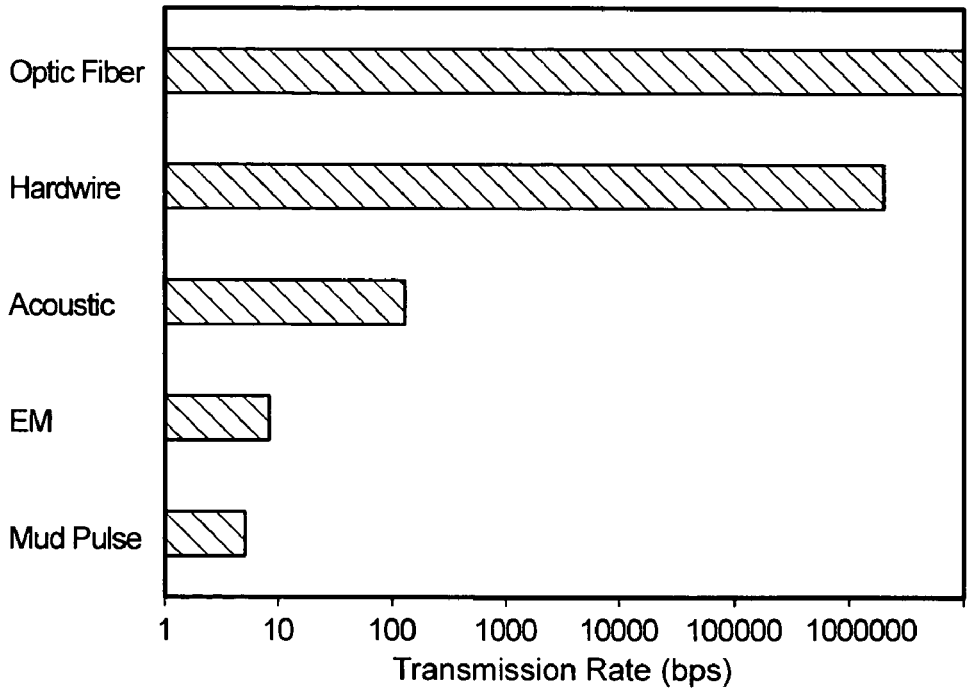
FIG. 3 is a graph illustrating transmission rates of different signals.

Telemetry systems using different media as the telemetry channel will have different data transmission rates. For example, the data transmission rate for acoustic signals traveling in drilling fluid (mud) is about 1.1 to 1.5 km/s. The data transmission rate for mud pulse telemetry systems may be estimated using Lamb's theory. The data transmission rate for an electromagnetic (EM) telemetry system is governed by either Maxwell's system of equations or telegraphy equations, which are well known in the art. Because the speed of sound in metals is significantly greater (steel ~5 km/s), the data transmission rate may be increased by propagating acoustic signals through the drill string. However, there is significant attenuation of the signal over long distances caused by material damping and dispersion of the signal as illustrated in FIG. 2. Furthermore, high-frequency signals decay faster than low-frequency signals. The operational frequency of a telemetry system therefore, impacts its data transmission rate. As illustrated in FIG. 3, the Hardwire and Optic Fiber data transmission rates are significantly greater than the other compared transmission rates.

Although conventional cable-based telemetry systems and hardwire telemetry systems may be preferred over other telemetry systems for UDRT applications, each of these systems may be substantially improved by incorporating them within a combined telemetry system comprising one or more sub-telemetry systems. Novel combined telemetry systems are therefore, achieved by combining various sub-telemetry systems which may or may not comprise the same media or telemetry channel. Exemplary embodiments are described in reference to upper and lower sub-telemetry systems, however, are not limited to the same. Other novel combinations may be apparent from the description and include, for example, the sub-telemetry systems set forth in Table 1.

As shown in Table 1, many possible combinations exist to form a combined telemetry system, however, only the last three (cable, hardwire drill pipe and/or hardwire casing) are practical for geosteering applications requiring UDRT. Combined telemetry systems may or may not require one or more middle sub-telemetry systems positioned between the upper and lower systems, depending on the depth of the wellbore, the type of system used and the operational costs of the wellbore. These sub-telemetry systems may use the same or different telemetry channels for data communications between two points in the wellbore or one point in the wellbore and the surface.

TABLE 1

| Sub-Telemetry Systems | Lower System | Middle System | Upper System |
|---|---|---|---|
| Mud | Yes | No | No |
| EM | Yes | Yes | Yes |
| Acoustic (Drill Pipe) | Yes | Yes | Yes |
| Acoustic (Casing) | No | Yes | Yes |
| Cable (fiber optic or electric wire cables) | Yes | Yes | Yes |
| Hardwire (Drill pipe) | Yes | Yes | Yes |
| Hardwire (Casing) | No | Yes | Yes |

The maximum transmission rate for combined telemetry systems is affected by the slowest sub-telemetry system. In a combined telemetry system, the length covered by each sub-telemetry system is reduced. Thus, these sub-telemetry systems may operate at higher frequencies yet are still able to maintain the same signal-to-noise level as if they are operated individually. A telemetry system transmission rate may therefore, improve after being combined with another telemetry system having a higher transmission rate.

Figure 1:
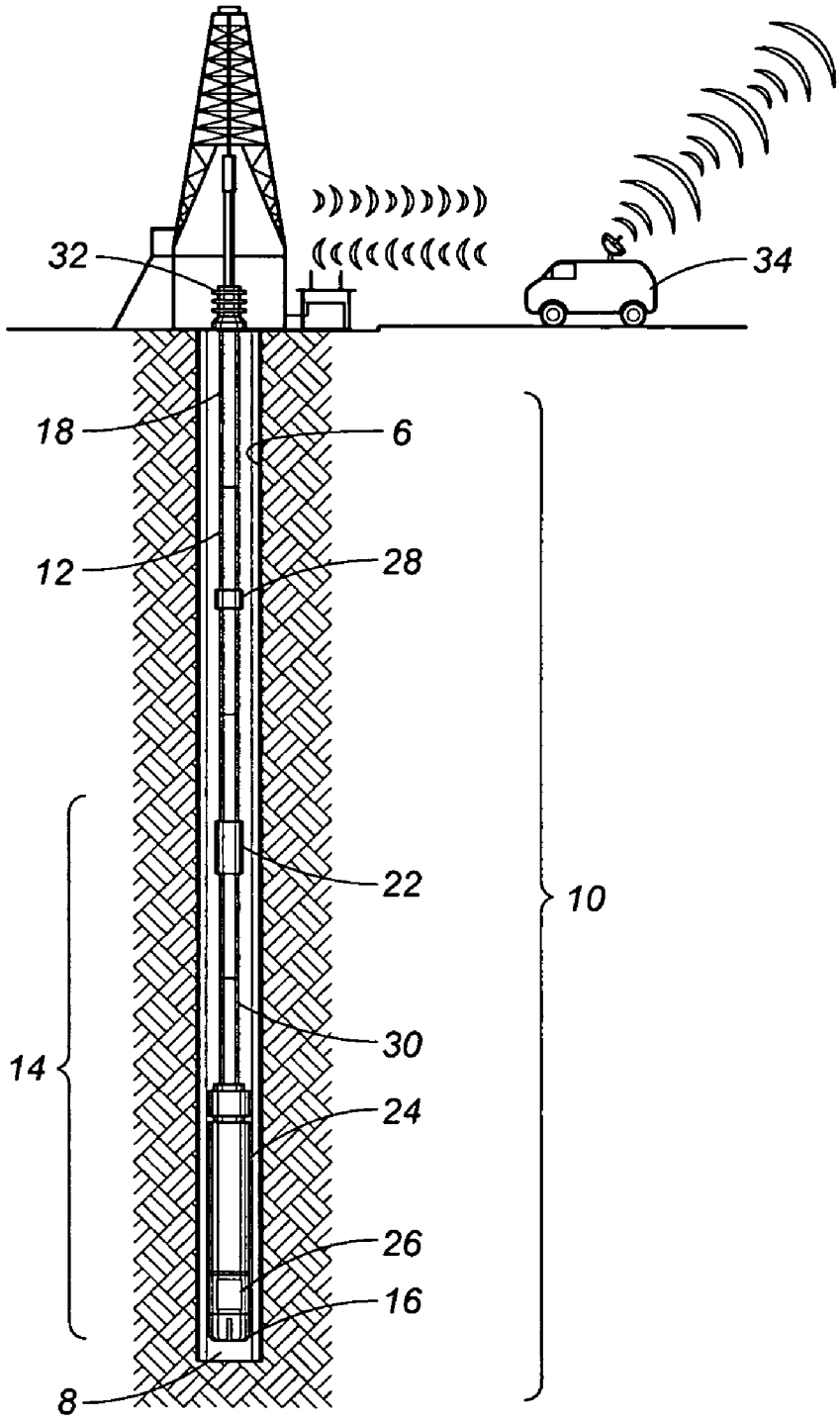
FIG. 1 is a schematic elevation of a rig and drill string illustrating one or more components that may be used in a combined telemetry system.

FIG. 1 generally illustrates one application of a combined telemetry system using a drill string 10 disposed in a wellbore 8 secured by casing 6. The drill string 10 includes a combination of drill pipe and any other tools that rotate the drill string 10 and transmit data signals to a data processing unit 34. A transceiver 32 is used to strip the transmitted signal off the drill string 10 and send it to the processing unit 34 and/or other remote data processing center(s). The upper portion of the drill string 10 may include drill pipe 12, a kelly 18, and a converter 28. A kelly is a long square or hexagonal steel bar with a hole drilled through the middle for fluid communication between each end of the kelly. The kelly 18 is used to rotate the drill string 10 while allowing the drill string 10 to be raised or lowered during operation. The kelly 18 and drill pipe 12 are coupled in a manner well known in the art. The converter 28 performs 2-way signal conversion so that signals may be relayed from one sub-telemetry system to another. Multiple converters may be used along the entire length of the drill string 10 (upper and lower) at strategic locations between sub-telemetry systems. For example, the converter 28 may be used to translate an acoustic signal received from the lower sub-telemetry system comprising the drill string to an electric signal carried by the upper sub-telemetry system comprising hardwire in the drill pipe 12.

The drill pipe 12 is a tubular steel conduit fitted with special threaded ends. The drill pipe 12 typically includes many segments and connects surface equipment with the bottomhole assembly 14 to transfer drilling fluid from the surface to the drill bit 16. The drill pipe 12 may be used to transport data across each joint by inductive coupling. Thus, each section of drill pipe 12 may be hardwired, or otherwise retrofitted, to function as an independent, sub-telemetry system.

The bottomhole assembly 14 may include a drill bit 16, a sensor sub 26, a stabilizer 22, a drill collar 24 and heavy-weight drill pipe 30. The bottomhole assembly 14 may also include directional drilling features such as the MWD, LWD, or geosteering systems. These components are each coupled in a manner well know in the art. The sensor sub 26 is typically used to acquire data used to direct the drill bit 16 in forming the wellbore 8. The sensor sub 26 may comprise one end of the combined telemetry system and the transceiver 32 or processing unit 34 may comprise the other end. A combined telemetry system may incorporate most, if not all, of the components in the drill string 10 to transmit data signals between the sensor sub 26 and the data processing unit 34.

A data back up system may be installed in the borehole assembly 14 to prevent data loss in case of an emergency. Further, power may be transmitted through the same cable and/or hardwire sub-telemetry systems used to transmit data signals between the surface and sensors positioned in the wellbore. Similar technology used in conventional data communication and network applications may be applied to the combined telemetry systems of the present invention with ordinary skill in the art. The implementation of a combined data and power-transmission system may involve the choice between several possible modulation schemes, depending on whether the power and signal are steady or modulated.

In the case of a nominally steady power-supply and signal, the data modulation may comprise brief interruptions in the signal; a simple amplifier circuit added to the power-conversion circuit in the downhole unit may pick off the modulation. The power-conversion circuit may be designed with sufficient reserve capacity using a capacitor, or other energy-storage device to supply power to the other circuits in the downhole unit during interruptions.

If the power-supply and signal are nominally a steady pulse train, then the pulse train may be modified for transmission of data by a differential Manchester Code. In the absence of data, the pulse train continues undisturbed; when data are present, some of the "on" pulses are changed to "off" pulses, and an equal number of "off" pulses are changed to "on" pulses. Because the total number of "on" and "off" pulses remain the same, the time-averaged transmitted power does not change. It is also possible to transmit data from downhole back to the surface along a combined data and power transmission system. A microprocessor-controlled data-transmission optoelectronic circuit in the remote station may be synchronized with the Manchester Code pulses; during the "off" periods of the Manchester Code, this circuit would transmit trains of relatively high-frequency data pulses.

In a telemetry system using hardwire drill pipe as the telemetry medium, the signal must be transmitted across each drill pipe connection or joint. This may be accomplished with either inductive coupling or capacitive coupling devices. The present invention proposes a novel-retrofitted coupling that may be used in a combined telemetry system with conventional drill pipe. This aspect of the present invention, therefore, is capable of converting ordinary drill pipe to hardwire drill pipe in a simple, efficient and economical manner—without modifying the dimensions of the drill pipe.

Figure 4:
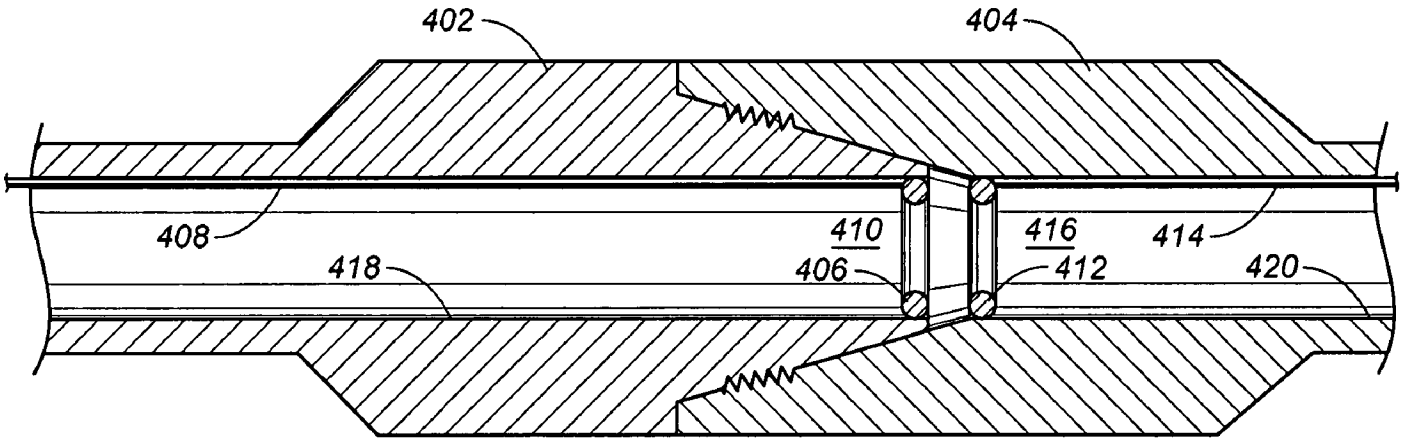
FIG. 4 is a cross section illustrating an inductive coupling that may be used with ordinary drill pipe in a telemetry system.

One example of converting ordinary drill pipe to hardwire drill pipe using inductive coupling is illustrated in FIG. 4. In this embodiment, a cross section of the pin end 402 of one drill pipe section is shown threaded to the box end 404 of another drill pipe section. Before the pin end 402 and box end 404 are connected, however, a pin end ring 406 and electric hardwire 408 are inserted into the pin end opening 410, and a box end ring 412 and electric hardwire 414 are inserted into the box end opening 416. A corresponding ring and electric hardwire are therefore, inserted into each pin end opening and box end opening for each section of drill pipe. Each electric hardwire 408, 414 may be attached to a corresponding ring 406, 412 in any manner appropriate for the transmission of a high-frequency electric current. For example, in a single section of drill pipe, the pin end ring may be permanently attached to one end of the hardwire before inserting them into the pin end opening, and the box end ring may be releasably connected to another end of the same hardwire using conventional hardwire connectors before inserting them into the box end opening. Conversely, the box end ring may be permanently attached to one end of the hardwire before inserting them into the box end opening, and the pin end ring may be releasably connected to another end of the same hardwire using conventional hardwire connectors before inserting them into the pin end opening. Additional hardwires may be connected to each ring 406, 412 as necessary. The rings 406, 412, may comprise any conventional conductive material that is, preferably, corrosion-resistant. Further, the rings 406, 412 may be insulated with a thin layer of dielectric material, or other well known, non-conductive insulation. Hardwires 408, 414, may be attached to the internal surface 418 of the pin end 402 and the internal surface 420 of the box end 404, respectively, or simply held in place by tension. Each ring 406, 412 may also be attached to an insert (not shown) for securing the same within a respective pin end opening 410 and box end opening 416 by friction fit or some other means available in the art.

Data transmission is achieved with a high-frequency electric signal propagating through, for example, hardwire 408 to ring 406. Ring 406 magnetically couples with ring 412, which transmits the signal to hardwire 414 and on to the next section of retrofitted hardwire drill pipe. The signal, however, may also couple with nearby materials, such as the pin end 402, the box end 404 and fluids traveling through the pin end opening 410 and box end opening 416. Dispersion and attenuation of the signal across this coupling may be minimized by reducing the distance between each ring 406, 412 and/or adding additional rings within each pin end opening 410 and box end opening 416. Nevertheless, the signal may need to be amplified as it propagates through multiple sections of drill pipe. In this event, a signal amplifier and power supply may be coupled to the ring as illustrated in FIG. 6. Other designs coupling this technology with the ring will be apparent from the description. Further, the hardwire may be used to provide power to the signal amplifier in the manner discussed above in reference to FIG. 1.

Figure 5:
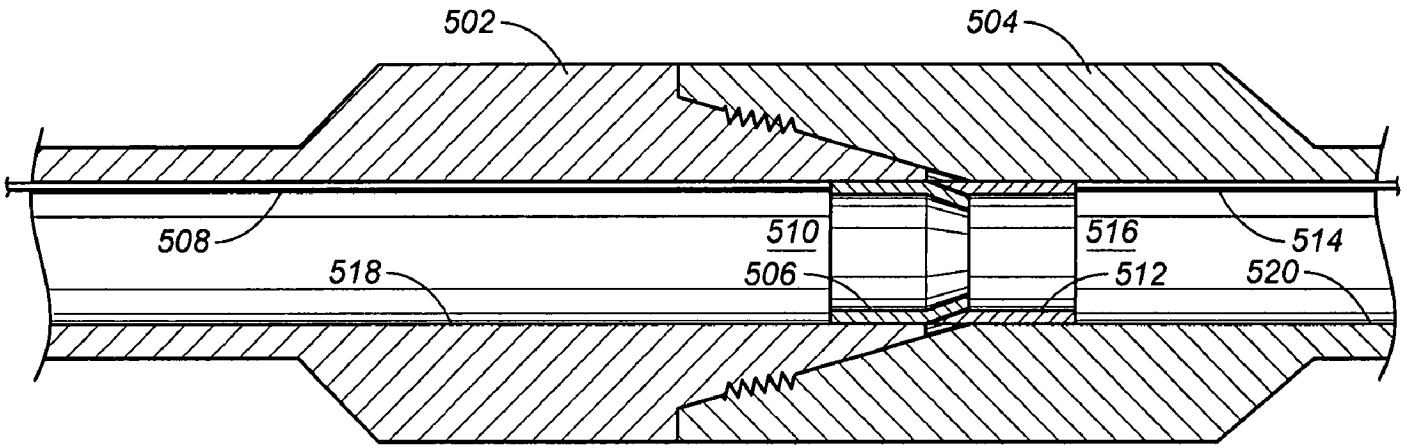
FIG. 5 is a cross section illustrating a capacitive coupling that may be used with ordinary drill pipe in a telemetry system.

Another example of converting ordinary drill pipe to hardwire drill pipe using capacitive coupling is illustrated in FIG. 5. In this embodiment, a cross-section of the pin end 502 of one drill pipe section is shown threaded to the box end 504 of another drill pipe section. Before the pin end 502 and box end 504 are connected, however, a pin end ring 506 and hardwire 508 are inserted into the pin end opening 510, and a box end ring 512 and electric hardwire 514 are inserted into the box end opening 516. A corresponding ring and electric hardwire are therefore, inserted into each pin end opening and box end opening for each section of drill pipe. Each hardwire 508, 514 may be attached to a corresponding ring 506, 512 in any manner appropriate for the transmission of a high-frequency electric current. For example, in a single section of drill pipe, the pin end ring may be permanently attached to one end of the hardwire before inserting them into the pin end opening, and a box end ring may be releasably connected to another end of the same hardwire using conventional hardwire connectors before inserting them into the box end opening. Conversely, the box end ring may be permanently attached to one end of the hardwire before inserting them into the box end opening, and the pin end ring may be releasably connected to another end of the same hardwire using conventional hardwire connectors before inserting them into the pin end opening. Additional hardwires may be connected to each ring 506, 512 as necessary. The rings 506, 512 may comprise any conventional conductive material that is, preferably, corrosion-resistant. Hardwires 508, 514 may be attached to the internal surface 518 of the pin end 502 and the internal surface 520 of the box end 504, respectively, or simply held in place by tension.

Data transmission is achieved with a high-frequency electric signal propagating through, for example, hardwire 508 to ring 506. Transmission of the signal from the ring 506 to the ring 512 may be achieved through (1) direct (galvanic) contact between the surfaces of each ring 506, 512; or (2) capacitive coupling when the rings 506, 512 are in close proximity but not in direct contact. Ring 512 transmits the signal to hardwire 514 and on to the next section of retrofitted hardwire drill pipe. The signal, however, may also couple with nearby materials, such as the pin end 502, the box end 504 and fluids traveling through the pin end opening 510 and box end opening 516. Dispersion and attenuation of the signal across this coupling may be minimized in the manner described in reference to FIG. 4. Amplification of the signal may also be achieved in the manner described in reference to FIG. 4.

Figure 6A:
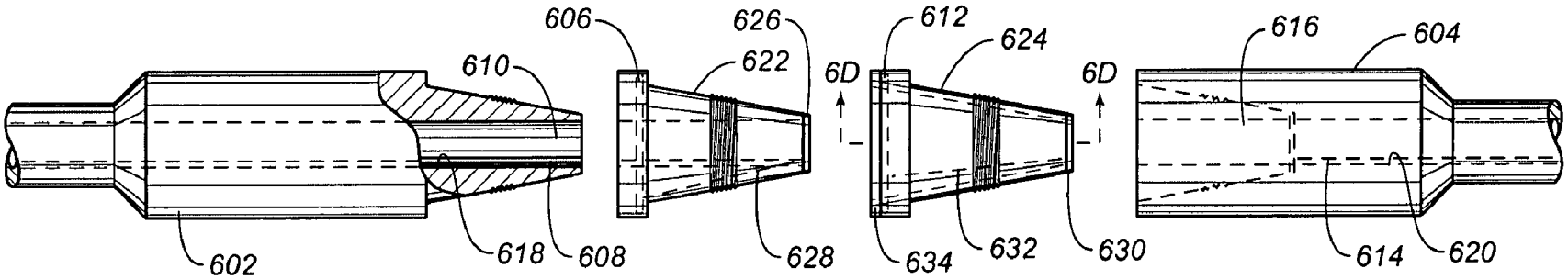
FIGS. 6A and 6B illustrate another embodiment of an inductive coupling that may be used with ordinary drill pipe in a telemetry system
Figure 6B:
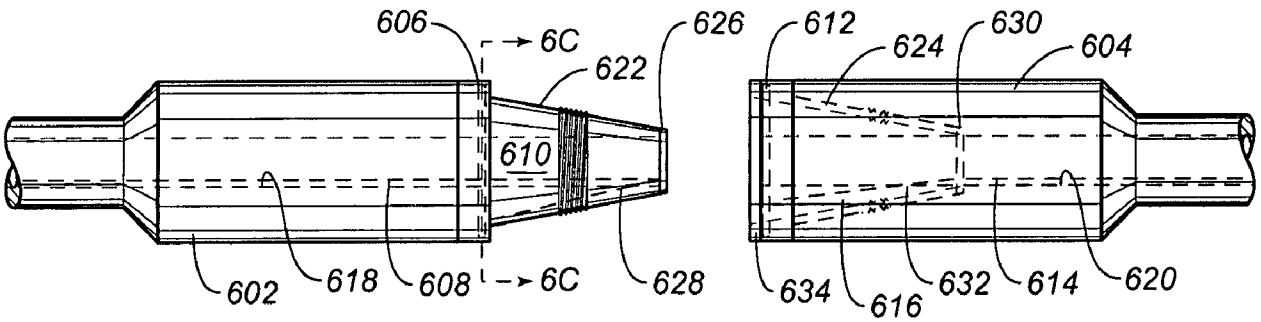

FIGS. 6A–6D illustrate yet another example of converting ordinary drill pipe into hardwire drill pipe using inductive coupling. In FIG. 6A, a cross-section of the pin end 602 of one drill pipe section is shown for coupling with the box end 604 of another drill pipe section. A conical pin end cap 622 and a conical box end insert 624 are each threaded for connection with the pin end 602 and box end 604, respectively, as illustrated in FIG. 6B. The pin end cap 622 includes a cap ring 606 and a cap plate 626. A cap wire 628 connects the cap ring 606 and the cap plate 626 for transmitting a high-frequency electric signal between the cap ring 606 and the cap plate 626 as further illustrated in FIG. 6C.

Similarly, insert 624 includes insert ring 612 and an insert plate 630. An insert wire 632 is used to connect the insert ring 612 and the insert plate 630 for transmitting a high-frequency electric signal between the insert ring 612 and the insert plate 630. The insert 624 also includes a signal amplifier and power supply 634 that may be used to amplify the signal for the purposes described in reference to FIGS. 4 and 5. The amplifier/power supply 634 is therefore, directly coupled with the insert ring 612 as further illustrated in FIG. 6D.

Figure 6C:
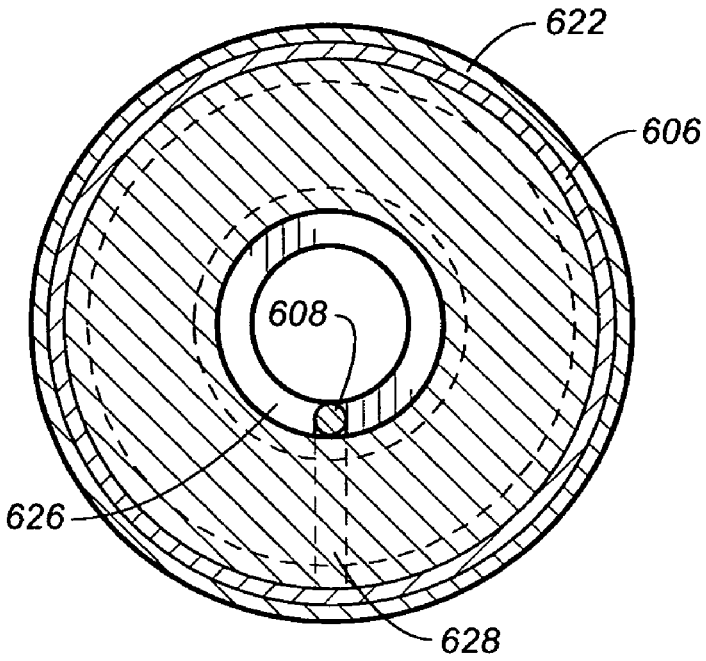
FIG. 6C is a cross-section of the inductive coupling in FIG. 6B along line 6C—6C.
Figure 6D:
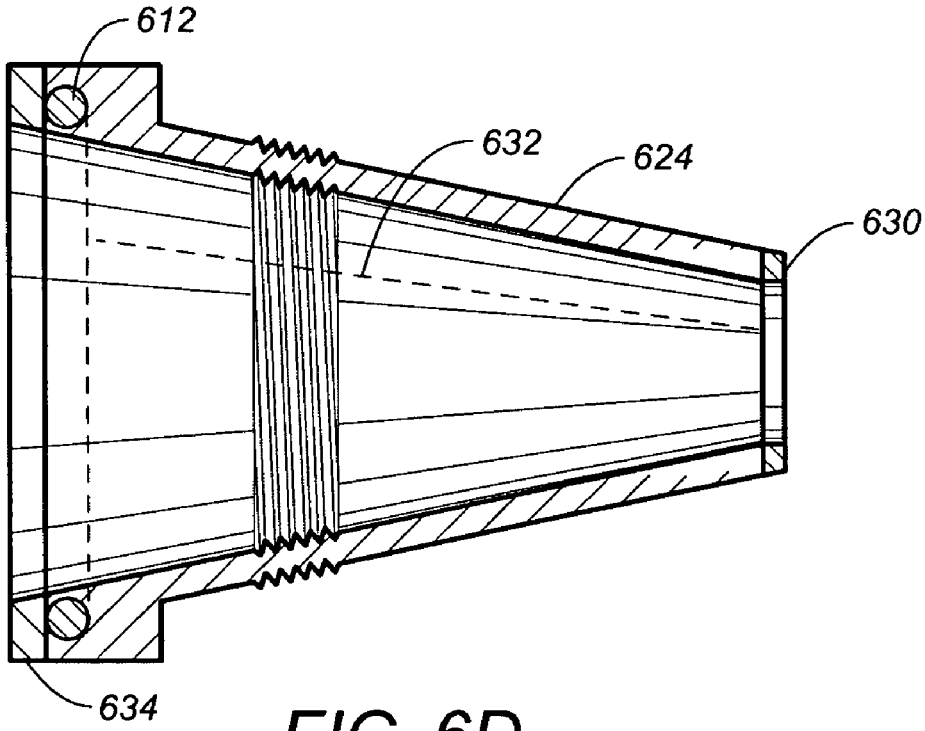
FIG. 6D is a cross section of the inductive coupling in FIG. 6A along line 6D—6D.

A pin end electric hardwire 608 is inserted in the pin end opening 610 before the cap 622 is connected to the pin end 602. Once the cap 622 is connected to the pin end 602, the hardwire 608 contacts the cap plate 626, creating a continuous electrical connection between the hardwire 608, the cap plate 626, the cap wire 628, and the cap ring 606 as illustrated in FIG. 6C. Likewise, once the insert 624 is connected to the box end 604, a box end electric hardwire 614 contacts the insert plate 630, creating a continuous electrical connection between the hardwire 614, the insert plate 630, the insert wire 632, and the insert ring 612. The hardwire contacts with the plates may be temporarily secured through conventional connections or simply through applied force between each hardwire 608, 614 and each respective plate 626, 630 with the assistance of a hardwire sheath or casing.

Once the cap 622 is threadably connected to the pin end 602 and the insert 624 is connected to the box end 604, the pin end 602 and box end 604 may be threadably connected, thus positioning the cap ring 606 and insert ring 612 in close proximity for inductive coupling in the manner described in reference to FIG. 4. Alternatively, the cap plate 626 and insert plate 630 may be replaced with inductive rings to serve the same purpose as rings 606, 612, respectively. This process may be repeated for each section of drill pipe, as necessary, for inductive coupling. Additional hardwire may be used as necessary. The rings 606, 612 and plates 626, 630 may comprise any conventional conductive material that is, preferably, corrosion-resistant. Further, these components may be insulated with a thin layer of dielectric material or other well-known non-conductive insulation. Hardwires 608, 614 may be attached to the internal surface 618 of the pin end 602 and the internal surface 620 of the box end 604, respectively, or simply held in place by tension. Dispersion and attenuation of the signal across this coupling may be minimized in the manner described in reference to FIG. 4. Amplification of the signal may also be achieved in the manner described in reference to FIG. 4.

In a telemetry system using fiber optic cable and/or electric cable as the telemetry medium, a shuttle and one or more cable spools may be required, depending on whether the cable is used for the upper or lower sub-telemetry system. Systems like that described in U.S. Pat. Nos. 6,041,872 and 6,655,453, incorporated herein by reference, may be used to deploy the cable in the upper and/or lower sub-telemetry systems. Accordingly, an upper cable spool may be positioned near the surface in the top drive or at some depth in the drill string, while the lower cable spool may be positioned in the drill string near the bottomhole assembly. Each spool must be large enough to accommodate the length and type of cable used. A cable based upper and lower sub-telemetry system, however, may suffer from numerous problems.

For example, the cable is subject to great tensile force and extreme environmental conditions requiring an armored or thicker cable. Limited space inside the top drive may impose untenable restrictions on the length of cable that may be used for the upper sub-telemetry system. As a result, additional cable spools may be required to cover the entire length of the wellbore. For each cable-to-cable connection between spools, there is a significant obstruction within the drill string, impairing the flow of drilling fluids. A combination of upper or lower cable based telemetry systems, however, reduces the required size of the upper spool, thereby minimizing the necessary modifications to the top drive. And, the cable-to-cable connection (obstruction) is avoided.

Figure 7A:
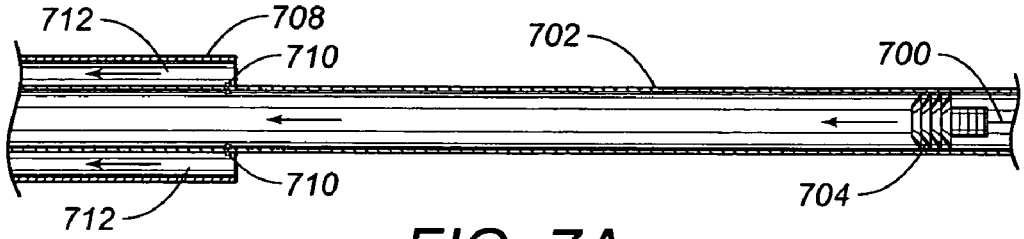
FIG. 7A illustrates initial deployment of a wet connect device and cable through a section of drill pipe.
Figure 7B:
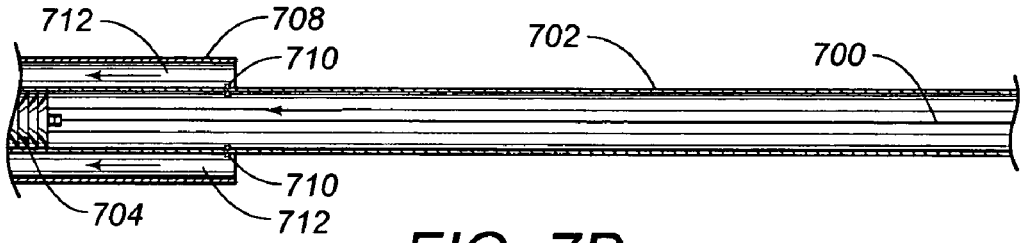
FIG. 7B illustrates full deployment of the wet connect device and cable in FIG. 7A.
Figure 7C:
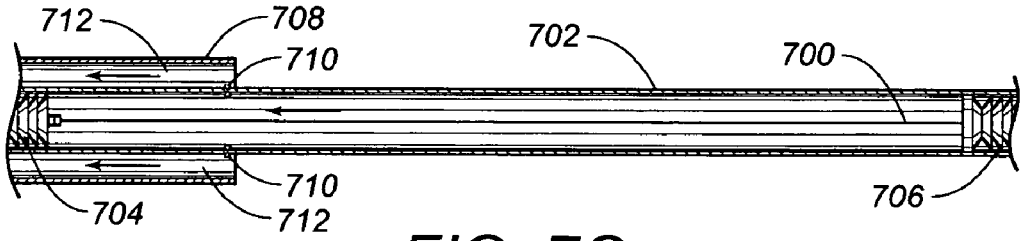
FIG. 7C illustrates the insertion of a plug behind the wet connect device and cable in FIG. 7B.
Figure 7D:
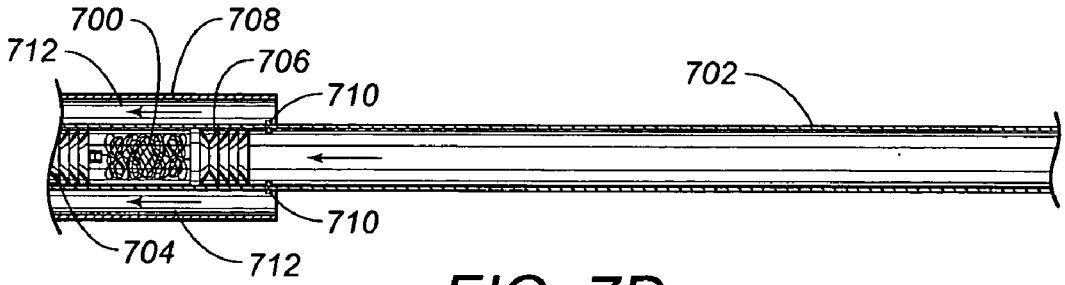
FIG. 7D illustrates compaction of the cable using the plug in FIG. 7C.

Telemetry systems using cable may require a retrieval system to rewind or store the cable. Conventional means of cable retrieval include rewinding the cables on a winch or a spool, or cutting the cable into fine pieces and flushing the pieces out with drilling fluid (mud). FIGS. 7A–7D illustrate one embodiment of a cable deployment and storage system for use in a lower cable sub-telemetry system. In FIG. 7A, the cable 700 is pumped with drilling fluid through the drill pipe 702 in the direction indicated using a wet connector 704 connected to one end of the cable 700. In FIG. 7B, the cable 700 is positioned in tension by securing the end connected to the wet connector 704 within the drill pipe 702 above a sensor sub (not shown) and the other end to a hanging sub (not shown) in the drill pipe 702. The sensor sub and hanging sub function in the manner described in reference to FIG. 1 and FIG. 8, respectively. Each is one component of a lower sub-telemetry system that may be used to acquire and/or transmit data from the drill bit and surrounding formation. The sensor sub may be positioned in the drill string near the drill bit, as shown in FIG. 1, or away from the drill bit, which may require "short hop" technology as described in U.S. Pat. No. 5,160,925, incorporated herein by reference. Any conventional wet connector may be used, provided it may receive a signal from the sensor sub when the two are coupled by means well known in the art. In FIGS. 7C–7D, the cable 700 is released from the hanging sub and a plug 706 is pumped with drilling fluid through the drill pipe 702 in the direction indicated. As the fluid forces the plug 706 through the drill pipe 702, the cable 700 is compacted within a garbage can device 708 for storage. One or more check valves 710 and channels 712 may be used to permit fluid communication through the drill pipe 702, around the garbage can 708, in the direction indicated. Other systems may be employed independent of, or in addition to, this system as illustrated in Table 2. These systems may be used simultaneously, sequentially, and in various sections of the wellbore.

TABLE 2

| | Lower Drill String | Middle Drill String | Upper Drill String |
|---|---|---|---|
| Winch/Spool | Yes | Yes | Yes |
| Cutter | Yes | Yes | Yes |
| Garbage Can | Yes | No | No |

Figure 8:
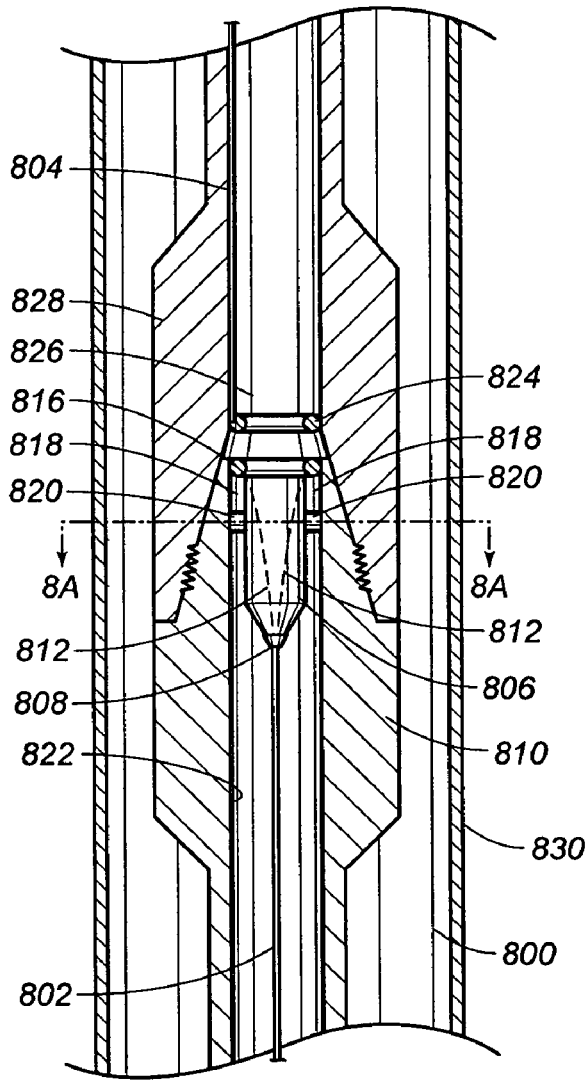
FIG. 8 is a cross section illustrating one embodiment of a combined telemetry system using hardwire drill pipe and cable.
Figure 8A:
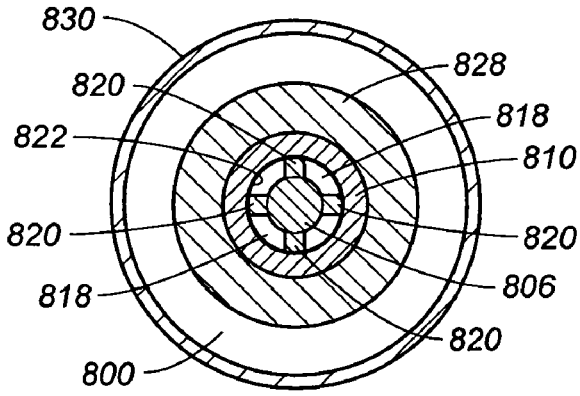
FIG. 8A is a cross section of the combined telemetry system in FIG. 8 along line 8A—8A.

Referring now to FIG. 8, one embodiment of a combined telemetry system using cable may comprise cable 802 carried within ordinary or heavy weight drill pipe as the lower sub-telemetry system, and ordinary drill pipe retrofitted with hardwire 804 as the upper sub-telemetry system. In this embodiment, the wellbore 800 may be initially formed using ordinary drill pipe and casing in a manner well known in the art. When the drill bit approaches the targeted formation zone, the cable 802 and a wet connector (not shown) are deployed through the drill pipe and coupled with a sensor sub in the manner described in reference to FIGS. 7A–7B. The cable 802 may comprise commercially available electric wireline or fiber optic wireline that is wound on a spool or winch at the surface and fed through the top drive or a side entry sub for deployment. If, however, the cable 802 is attached directly to the drill bit, it may be deployed during tripping in operations as described in U.S. Pat. No. 6,555,453. Once the cable 802 is coupled with the sensor sub, the cable 802 is cut above the last section of drill pipe nearest the surface. An upper end 808 of the cable 802 is then fed into a hanging sub 806, which is positioned within a pin end opening 818 of a section of drill pipe 810. The hanging sub 806 is held in position within the pin end opening 818 by a plurality of actuating arms 820 for releasable engagement with an internal surface 822 of the drill pipe 810. Alternatively, actuating arms 820 may be actuated for permanent engagement with the internal surface 822 by means well known in the art. As shown in FIG. 8A, a limited number of arms 820 are preferred in order to permit fluid communication through the pin end opening 818 around the hanging sub 806.

The hanging sub 806 includes one or more electrical wires 812, which provide signal communication between the cable 802 and a pin end ring 816 that is attached to the hanging sub 806. A box end ring 824 is positioned in the box end opening 826 of another section of drill pipe 828 that is threadably connected to the drill pipe section 810. An electrical hardwire 804 is connected to the box end ring 824 in the manner described in reference to FIG. 4. The inductive coupling described in reference to FIG. 4 is therefore, utilized to transfer a data signal from the lower sub-telemetry system comprising the cable 802 to the upper sub-telemetry system comprising the hardwire 804. If necessary, a power supply and amplifier may be coupled with the pin end ring 816 or the box end ring 824 in the manner described in reference to FIG. 4 for amplifying the signal. If the cable 802 comprises fiber optic wire line, then a converter may be necessary to translate the fiber optic signal into an electric signal. As described in reference to FIG. 1, signal conversion technology is well known in the art and incorporating such technology into the hanging sub 806 between the upper end 808 of the cable 802 and the pin end ring 816 will be apparent to those with skill in the art.

The drill pipe retrofitted with hardwire 804 covers the remaining upper sub-telemetry system and may be coupled to a saver sub at the surface of the wellbore. The saver sub may be retrofitted with inductive coupling as described in reference to FIG. 4 so that it may accept the data signal. Alternatively, the saver sub, hanging sub and drill pipe comprising the upper sub-telemetry system may be retrofitted in the manner described in reference to FIG. 5 or 6. The data signal must then be transmitted from the rotating saver sub to a stationary receiver, which may be accomplished using conventional technology including, for example, a swivel, power supply and wireless radio transmitter coupled to the saver sub.

Alternatively, the upper sub-telemetry system may comprise cable and the lower sub-telemetry system may comprise hardwire drill pipe. This embodiment is virtually the same combined telemetry system described in reference to FIG. 8, but inverted. Ordinary drill pipe, retrofitted in the manner described in reference to FIG. 8, is coupled to a sensor sub that is retrofitted in the same manner. The sensor sub and drill pipe comprising the lower telemetry system may be retrofitted, however, as described in reference to FIG. 5 or 6. The retrofitted drill pipe, sensor sub and a drill bit are then used to initially form the wellbore in a manner well known in the art. Once the drill bit reaches the targeted formation zone, the cable may be attached to a hanging sub, which is positioned in ordinary drill pipe as described in reference to FIG. 8. The cable may then be deployed with ordinary drill pipe to complete the wellbore, as further described in U.S. Pat. No. 6,655,453. The ordinary drill pipe in the upper sub-telemetry system may be coupled to a conventional saver sub at the surface of the wellbore by means well known in the art.

Figure 9:
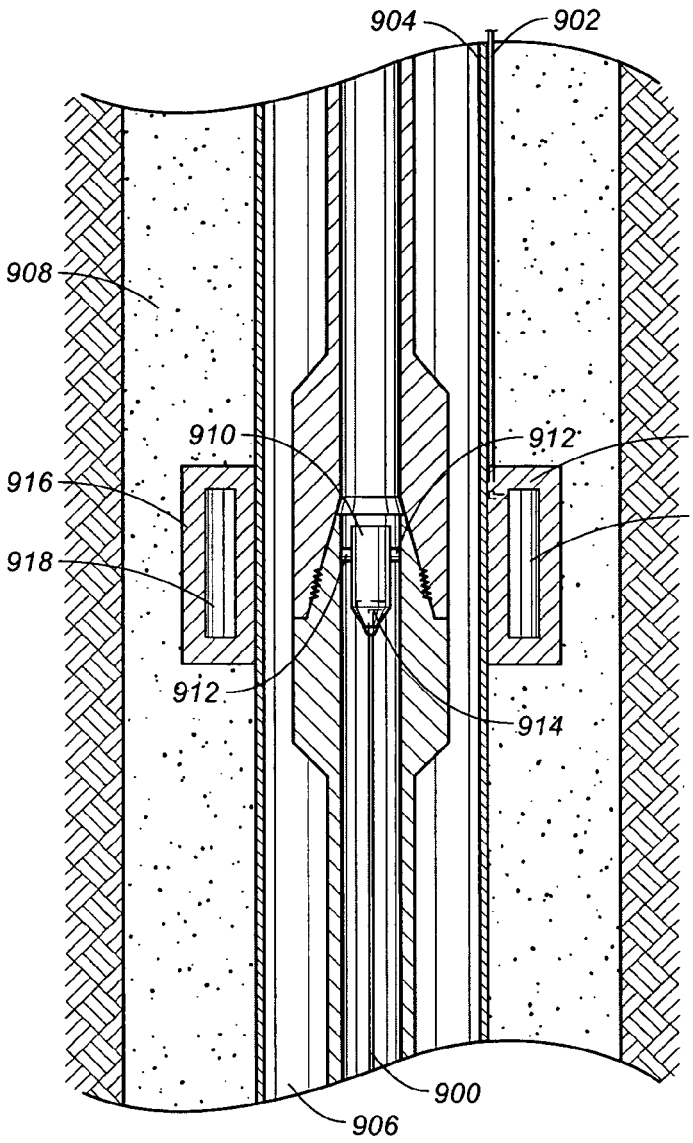
FIG. 9 is a cross section illustrating another embodiment of a combined telemetry system using hardwire casing and cable.

Referring now to FIG. 9, another embodiment of a combined telemetry system using cable may comprise cable 900 for the lower sub-telemetry system and ordinary casing 904 that is retrofitted with electrical hardwire 902 for the upper sub-telemetry system. The wellbore is initially formed using ordinary drill pipe and casing in a manner well known in the art. When the drill bit reaches the targeted formation zone, the cable 900 may be deployed and secured within the drill pipe between a wet connector (not shown) and hanging sub 910 in the manner described in referenced to FIG. 8. Ordinary drill pipe may be used to complete the wellbore in a manner well known in the art. The hanging sub 910 includes actuating arms 912 that may releasably or permanently secure the hanging sub 910 as described in reference to FIG. 8. The hanging sub 910 may also include a wireless transmitter and power supply 914 which may be manufactured using technology well known in the art. The hardwire 902 is run with casing 904 ("hardwire casing") as the casing 904 is lowered into the wellbore 906 and eventually secured by cement 908. The hardwire 902 may cover the entire wellbore 906, or just the upper sub-telemetry system as illustrated in FIG. 9. A casing shoe 916 surrounds the casing 904 at a transition point between the upper sub-telemetry system and the lower sub-telemetry system. The casing shoe 916 holds a receiver 918, which also surrounds the casing 904. The hardwire 902 is coupled with the receiver 918. Signals transmitted from the wireless transmitter 914 may be received by the receiver 918 and propagated through the hardwire 902 directly to a data processing center at the surface. As discussed in reference to FIG. 8, a converter may be incorporated in the hanging sub 910 if necessary to convert a fiber optic signal to an electric signal.

Figure 10:
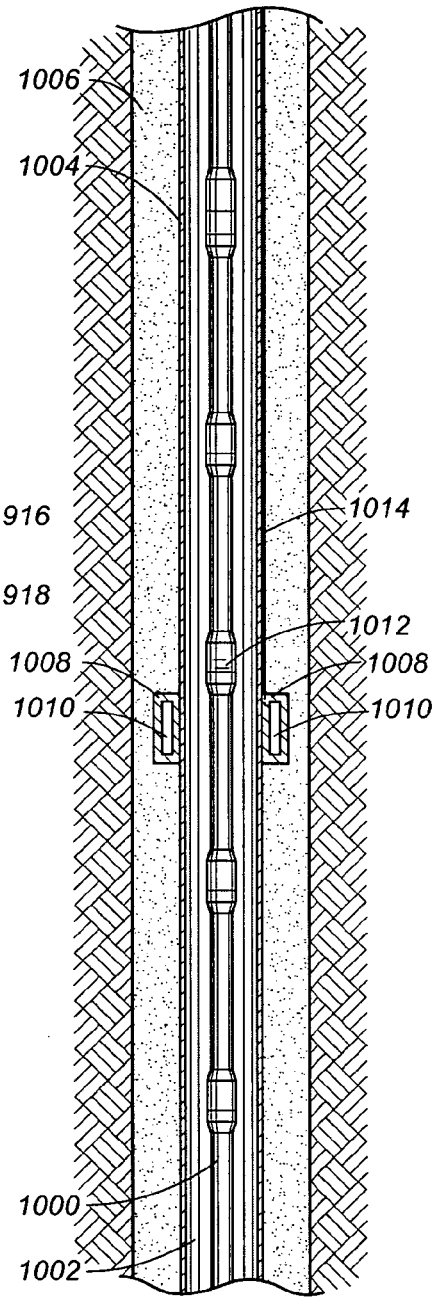
FIG. 10 is a cross section illustrating another embodiment of a combined telemetry system using hardwire casing and hardwire drill pipe.

The present invention also contemplates embodiments of a combined telemetry system that do not require the use of cable as illustrated in FIG. 10. For example, the lower sub-telemetry system may comprise ordinary drill pipe that is retrofitted in the manner described in reference to FIG. 4, 5 or 6 to form hardwire drill pipe 1000. The hardwire drill pipe 1000 is used to form the wellbore 1002 in a manner well known in the art until the drill bit reaches the targeted formation zone. As the wellbore 1002 is formed, casing 1004 is run in the wellbore 1002 with the hardwire drill pipe 1000 and secured with cement 1006. A casing shoe 1008 surrounds the casing 1004 at a transition point between the upper sub-telemetry system and the lower sub-telemetry system. The casing shoe 1008 holds a receiver 1010, which also surrounds the casing 1004. The upper sub-telemetry system comprising hardwire 1014 is run with casing 1004 ("hardwire casing") as the casing 1004 is lowered into the wellbore 1002. The hardwire 1014 may cover the entire wellbore 1002 or just the upper sub-telemetry system as illustrated in FIG. 10. The hardwire 1014 is coupled with the receiver 1010. The hardwire drill pipe 1000 also includes a wireless transmitter and power supply 1012 that may be installed at a joint in the hardwire drill pipe 1000 nearest the receiver 1010. The receiver 1010 and wireless transmitter/power supply 1012 may be manufactured using technology well known in the art. Further, the hardwire drill pipe 1000 and/or hardwire 1014 may serve as a power source as discussed above in reference to FIG. 1.

Signals transmitted from the wireless transmitter 1012 may be received by the receiver 1010 and propagated through the hardwire 1014 directly to a data processing center at the surface. Ordinary drill pipe may be used to complete the wellbore 1002 above the drill pipe joint containing the wireless transmitter 1012. The hardwire drill pipe 1000 comprising the lower sub-telemetry system may be coupled to a sensor sub that is retrofitted in the manner described in reference to FIG. 4, 5 or 6. The ordinary drill pipe comprising the upper sub-telemetry system may be coupled to a saver sub in a manner well known in the art.

Other possible combinations of sub-telemetry systems described in Table 1 may be preferred, depending upon wellbore conditions and operating costs. These combinations may be achieved through the systems described herein, and modifications thereto that are apparent from the description. The present invention therefore, may reduce the costs associated with specially manufactured or modified hardwire drill pipe. Moreover, the problems associated with the use of hardwire drill pipe or cable over the entire length of the wellbore are substantially overcome by the present invention, thereby reducing the overall cost of production.

The invention claimed is:

1. A combined telemetry system for communicating a signal between multiple positions in a wellbore comprising:

a lower sub-telemetry system, the lower sub-telemetry system coupled at one end to a sensor;

an upper sub-telemetry system, the upper sub-telemetry system coupled at one end to another end of the lower sub-telemetry system and coupled at another end to at least one of a signal receiver and a signal transmitter; and a signal converter coupled between the upper sub-telemetry system and the lower sub-telemetry system for converting one type of signal communicated through at least one of the lower sub-telemetry system and the upper sub-telemetry system to another type of signal communicated through at least one of the upper sub-telemetry system and the lower sub-telemetry system.

2. The system of claim 1, wherein the signal comprises at least one of data and power, the signal being selected from a group comprising acoustic, electric, electromagnetic or optic signals.

3. The system of claim 1, wherein the one end of the lower sub-telemetry system defines a first axial position in the wellbore and the another end of the lower sub-telemetry system defines a second axial position in the wellbore, the signal being communicated between the first axial position and the second axial position.

4. The system of claim 3, wherein the one end of the upper sub-telemetry system defines a third axial position in the wellbore and the another end of the upper sub-telemetry system defines a fourth axial position in the wellbore, the signal being communicated between the first axial position, the second axial position, the third axial position and the fourth axial position.

5. The system of claim 1, wherein the lower sub-telemetry system is selected from a group comprising drill pipe, casing, mud, cable, hardwire drill pipe, hardwire casing or fiber optic cable, and the upper sub-telemetry is selected from a group comprising drill pipe, casing, mud, cable, hardwire drill pipe, hardwire casing or fiber optic cable.

6. The system of claim 1, wherein the sensor communicates the signal from at least one of the weilbore and the lower sub-telemetry system to at least one of the lower sub-telemetry system and at least one of a drill bit and a motor coupled to the sensor.

7. The system of claim 1, wherein the signal receiver receives the signal from at least one of the upper sub-telemetry system and the signal transmitter.

8. The system of claim 7, wherein the signal transmitter transmits the signal from at least one of a surface of the wellbore and the signal receiver to at least one of the surface of the wellbore and the signal receiver.

9. The system of claim 1, wherein the signal is communicated between the multiple positions in the wellbore at a rate of at least about 1,000 bps.

10. A combined telemetry system for communicating a signal between multiple positions in a wellbore comprising:

a lower sub-telemetry system comprising cable, the lower sub-telemetry system coupled at one end to a sensor;

an upper sub-telemetry system comprising hardwire drill pipe, the upper sub-telemetry system coupled at one end to another end of the lower sub-telemetry system and coupled at another end to at least one of a signal receiver and a signal transmitter; and a hanging sub for coupling the lower sub-telemetry system to the upper sub-telemetry system, the hanging sub and the hardwire drill pipe using at feast one of inductive coupling and capacitive coupling to communicate the signal between the lower sub-telemetry system and the upper sub-telemetry system.

11. A combined telemetry system for communicating a signal between multiple positions in a wellbore comprising:

a lower sub-telemetry system comprising hardwire drill pipe, the lower sub-telemetry system coupled at one end to a sensor;

an upper sub-telemetry system comprising cable, the upper sub-telemetry system coupled at one end to another end of the lower sub-telemetry system and coupled at another end to at least one of a signal receiver and a signal transmitter; and a hanging sub for coupling the lower sub-telemetry system to the upper sub-telemetry system, the hanging sub and the hardwire drill pipe using at least one of inductive coupling and capacitive coupling to communicate the signal between the lower sub-telemetry system and the upper sub-telemetry system.

12. A combined telemetry system for communicating a signal between multiple positions in a wellbore comprising:

a lower sub-telemetry system, the lower sub-telemetry system coupled at one end to a sensor; and an upper sub-telemetry system, the upper sub-telemetry system coupled at one end to another end of the lower sub-telemetry system and coupled at another end to at least one of a signal receiver and a signal transmitter, wherein the lower sub-telemetry system comprises cable and the upper sub-telemetry system comprises hardwire casing and a casing shoe, the casing shoe at least partially surrounding the hardwire casing at the one end of the upper sub-telemetry system.

13. The system of claim 12, further comprising a hanging sub for coupling the lower sub-telemetry system to the upper sub-telemetry system, the hanging sub and the casing shoe each comprising a power source and at least one of a transmitter and a receiver for communicating the signal between the lower sub-telemetry system and the upper sub-telemetry system.

14. A combined telemetry system for communicating a signal between multiple positions in a wellbore comprising:

a lower sub-telemetry system, the lower sub-telemetry system coupled at one end to a sensor; and an upper sub-telemetry system, the upper sub-telemetry system coupled at one end to another end of the lower sub-telemetry system and coupled at another end to at least one of a signal receiver and a signal transmitter, wherein the lower sub-telemetry system comprises hardwire drill pipe and the upper sub-telemetry system comprises hardwire casing and a casing shoe, the casing shoe at least partially surrounding the hardwire casing at the one end of the upper sub-telemetry system.

15. The system of claim 14, wherein the hardwire drill pipe and the casing shoe each comprise a power source and at least one of a transmitter and receiver for communicating the signal between the lower sub-telemetry system and the upper sub-telemetry system, the power source and the at least one of the transmitter and the receiver for the hardwire drill pipe positioned at the another end of the lower sub-telemetry system.

16. A combined telemetry system for communicating a signal between multiple positions in a wellbore comprising:

a lower sub-telemetry system;

an upper sub-telemetry system;

a middle sub-telemetry system for coupling the lower sub-telemetry system to the upper sub-telemetry; and converters between the sub-telemetry systems for relaying signals from one sub-telemetry system to another.

17. The system of claim 16, wherein the middle sub-telemetry system comprises multiple sub sub-telemetry systems.

18. The system of claim 16, wherein the converters convert one type of signal to another type of signal.

19. A combined telemetry system for communicating a signal between multiple positions in a wellbore comprising:

a lower sub-telemetry system, the lower sub-telemetry system coupled at one end to a sensor; and an upper sub-telemetry system, the upper sub-telemetry system coupled at one end to another end of the lower sub-telemetry system and coupled at another end to at least one of a signal receiver and a signal transmitter, wherein the signal is communicated between the multiple positions in the wellbore at a rate of at least about 1,000 bps.

20. The system of claim 19, wherein the signal comprises at least one of data and power, the signal being selected from a group comprising acoustic, electric, electromagnetic or optic signals.

21. The system of claim 19, wherein the one end of the lower sub-telemetry system defines a first axial position in the wellbore and the another end of the lower sub-telemetry system defines a second axial position in the wellbore, the signal being communicated between the first axial position and the second axial position.

22. The system of claim 21, wherein the one end of the upper sub-telemetry system defines a third axial position in the weilbore and the another end of the upper sub-telemetry system defines a fourth axial position in the wellbore, the signal being communicated between the first axial position, the second axial position, the third axial position and the fourth axial position.

23. The system of claim 19, wherein the lower sub-telemetry system is selected from a group comprising drill pipe, casing, mud, cable, hardwire drill pipe, hardwire casing or fiber optic cable, and the upper sub-telemetry is selected from a group comprising drill pipe, casing, mud, cable, hardwire drill pipe, hardwire casing or fiber optic cable.

24. The system of claim 19, wherein the sensor communicates the signal from at least one of the wellbore and the lower sub-telemetry system to at least one of the lower sub-telemetry system and at least one of a drill bit and a motor coupled to the sensor.

25. The system of claim 19, wherein the signal receiver receives the signal from at least one of the upper sub-telemetry system and the signal transmitter.

26. The system of claim 24, wherein the signal transmitter transmits the signal from at least one of a surface of the wellbore and the signal receiver to at least one of the surface of the wellbore and the signal receiver.

27. A combined telemetry system for communicating a signal between multiple positions in a wellbore comprising:

a lower sub-telemetry system, the lower sub-telemetry system coupled at one end to a sensor; and an upper sub-telemetry system, the upper sub-telemetry system coupled at one end to another end of the lower sub-telemetry system and coupled at another end to at least one of a signal receiver and a signal transmitter, wherein at least one of the lower sub-telemetry system and the upper sub-telemetry system comprises a coupling system, the coupling system comprising:

a first ring coupled with a first transmission wire; and a second ring coupled with a second transmission wire.

28. The system of claim 27, wherein at least one of the first transmission wire and the second transmission wire is provided in the form of a hard wire in hard wire drill pipe having a tubular passage there through.

29. The system of claim 28, wherein the first ring and the first transmission wire are positioned at least partially within the tubular passage of one of the drill pipe sections and the second ring and the second transmission wire are positioned at least partially within the tubular passage of another one of the drill pipe sections, the position of the first ring being sufficiently dose in proximity to the position of the second ring to transmit an electric signal through at least one of inductive coupling and capacitive coupling.

30. The system of claim 29, wherein the electric signal comprises at least one of data and power.

31. The system of claim 28, wherein the first ring is secured within the tubular passage of one of the drill pipe sections by a friction fit, and the second ring is secured within the tubular passage of another one of the drill pipe sections by a friction fit.

32. The system of claim 28, wherein the first transmission wire and the second transmission wire are each attached to an internal surface of the tubular passage for a respective drill pipe section.

33. The system of claim 27, wherein the first ring is coupled to the first transmission wire by a releasable hard wire connector, and the second ring is coupled to the second transmission wire by a releasable hard wire connector.

34. The system of claim 27, wherein the first ring comprises a first tapered section and the second ring comprises a second tapered section, the first tapered section having a smaller outside diameter than an inside diameter of the second tapered section so that the first tapered section fits at least partially within the second tapered section.

35. The system of claim 27, wherein the one end of the lower sub-telemetry system defines a first axial position in the wellbore and the another end of the lower sub-telemetry system defines a second axial position in the wellbore, the signal being communicated between the first axial position and the second axial position.

36. The system of claim 35, wherein the one end of the upper sub-telemetry system defines a third axial position in the wellbore and the another end of the upper sub-telemetry system defines a fourth axial position in the wellbore, the signal being communicated between the first axial position, the second axial position, the third axial position and the fourth axial position.

37. The system of claim 27, wherein the lower sub-telemetry system is selected from a group comprising drill pipe, casing, mud, cable, hardwire drill pipe, hardwire casing or fiber optic cable, and the upper sub-telemetry is selected from a group comprising drill pipe, casing, mud, cable, hardwire drill pipe, hardwire casing or fiber optic cable.

38. The system of claim 27, wherein the sensor communicates the signal from at least one of the weilbore and the lower sub-telemetry system to at least one of the lower sub-telemetry system and at least one of a drill bit and a motor coupled to the sensor.

39. The system of claim 27, wherein the signal receiver receives the signal from at least one of the upper sub-telemetry system and the signal transmitter.

40. The system of claim 39, wherein the signal transmitter transmits the signal from at least one of a surface of the wellbore and the signal receiver to at least one of the surface of the wellbore and the signal receiver.

41. The system of claim 27, wherein the signal is communicated between the multiple positions in the wellbore at a rate of at least about 1,000 bps.

* * * * *